United States Patent [19]

Barrash

[11] 4,296,861

[45] * Oct. 27, 1981

[54] ELASTIC BAND AND HANDLE STRUCTURE FOR FORMING PACKAGES OF GROUPS OF CONTAINERS

[75] Inventor: Marshall J. Barrash, Atlanta, Ga.

[73] Assignee: The Coca-Cola Company, Atlanta, Ga.

[ * ] Notice: The portion of the term of this patent subsequent to May 26, 1998, has been disclaimed.

[21] Appl. No.: 161,493

[22] Filed: Jun. 20, 1980

Related U.S. Application Data

[63] Continuation-in-part of Ser. No. 65,421, Aug. 10, 1979.

[51] Int. Cl.[3] ..... B65D 75/56; B65D 85/62

[52] U.S. Cl. ..... 206/428; 229/52 AL; 16/110.5

[58] Field of Search ..... 206/428, 497, 459; 229/52 AL, 52 A, DIG. 12; 16/110.5

[56] References Cited

U.S. PATENT DOCUMENTS

| | | | |
|---|---|---|---|
| 1,909,368 | 5/1933 | Lloyd | 229/52 AL |
| 2,562,268 | 7/1951 | Gratzner | 16/110.5 |
| 2,884,328 | 4/1959 | Johnson | 229/DIG. 12 |
| 2,955,739 | 10/1960 | Corrura | 206/428 |
| 3,013,655 | 12/1961 | Brody | 206/428 |
| 3,031,359 | 4/1962 | Blank et al. | 229/52 AL |
| 3,557,516 | 1/1971 | Brandt | 206/428 |
| 3,567,108 | 3/1971 | Corridon | 229/52 AL |

*Primary Examiner*—William T. Dixson, Jr.

*Attorney, Agent, or Firm*—Birch, Stewart, Kolasch & Birch

[57] ABSTRACT

A combined elastic endless band and integral handle strap for defining and carrying multiple container package configuration is provided in which the handle strap is loosely associated with the endless band in an unstretched condition of the latter and flush with the said endless band in a stretched condition of the latter. In another embodiment there is provided a laminated handle structure constructed of a strip of adhesive tape having exposed adhesive layers at the ends thereof for affixing it to the package. The package is of any suitable material including shrink film, stretch film and paperboard. The gripping portion of the handle is provided by a printed laminate adhered to the adhesive layer on the tape, the latter being sufficiently transparent to permit viewing of printed indicia on the laminate.

7 Claims, 8 Drawing Figures

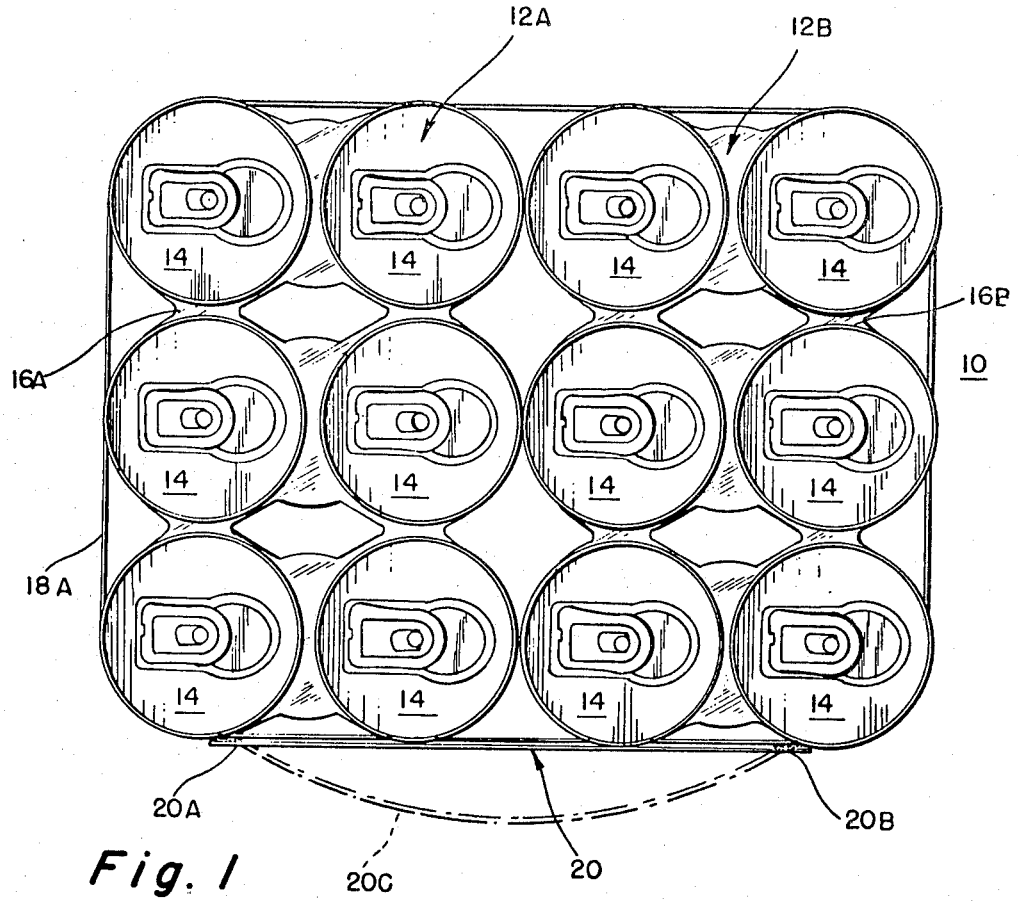
Fig. 1
Fig. 2
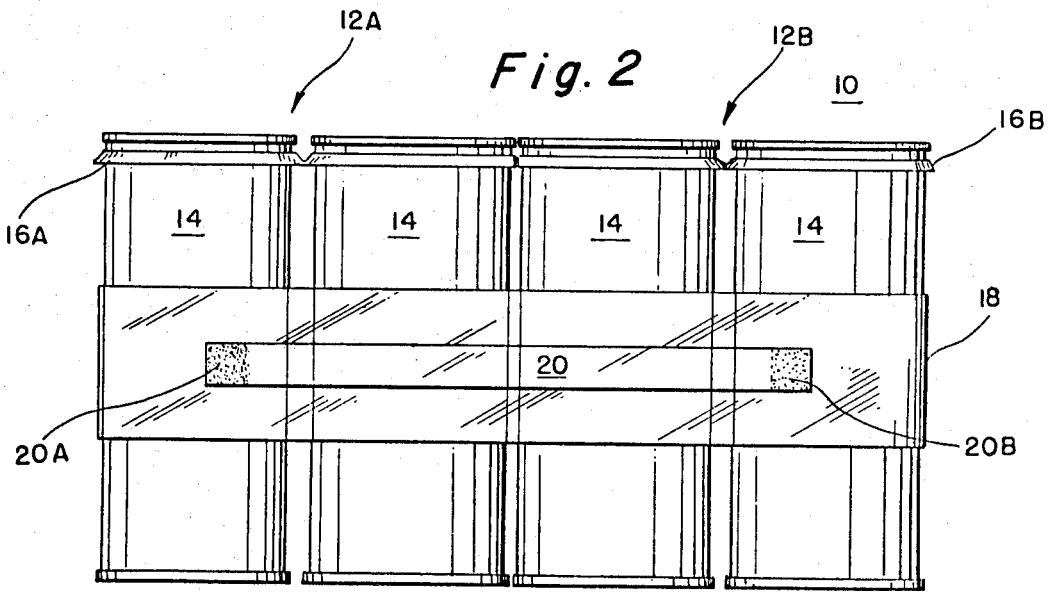

ELASTIC BAND AND HANDLE STRUCTURE FOR FORMING PACKAGES OF GROUPS OF CONTAINERS

This application is a continuation-in-part of co-pending application Ser. No. 65,421, filed Aug. 10, 1979, of Marshall J. Barrash, for Elastic Band And Handle Structure For Forming Packages Of Groups Of Containers.

FIELD OF THE INVENTION

This invention relates to packaging groups of containers and more particularly, to elastic banding means in combination with an integral handle structure for maintaining groups of containers such as cylindrical beverage cans in predetermined packaged groups and means for mounting the handle structure while providing space thereon for indicia and the like.

BACKGROUND OF THE INVENTION

In the prior art, bottles and cans have been prepackaged in six-pack configurations by shrink films such as illustrated in U.S. Pat. No. 3,217,874 to Potter, issued Nov. 16, 1965, in which the plastic sheet or tube which is shrink fitted to the six-pack includes finger grips or the like for the purpose of carrying that six-pack.

Another type of packaging for six-packs or other prearranged groupings of containers is by way of elastic bands with or without the additional expedient of elastic neck or container top engaging matrices shaped in accordance with the desired formation of the six-pack or other multiples of containers. Such an arrangement is illustrated in FIG. 19 of U.S. Pat. No. 3,714,756 of MacInnes et al, issued Feb. 6, 1973. This patent also illustrates suitable mechanism by which an elastic band may be placed around a group of containers to maintain that group in a predetermined multi-container package shape. The additional neck engaging portion of the package is illustrated in FIG. 19 of MacInnes as including finger holes for the purpose of transporting the package from place to place.

It is an object of the present invention to provide a package banding structure for packages of multiple containers which include either two forms of container holding devices such as illustrated in the MacInnes patent or which are merely arranged in groups of six or twelve or the like and held only by the banding device around the vertical sides of the containers, the said elastic banding structure including an integral handle means of novel construction.

Still another object of the present invention is to provide a new and novel elastic banding structure for packaging groups of containers in which a handle means is integrally affixed to the banding device by adhesive such that when the banding device is stretched, the handle will be in a relatively unstressed condition lying flat against the stretched elastic band.

Yet another object of the present invention is to provide a handle means for multiple container packs in which the handle means is of laminated construction with exposed adhesive coated end areas and the surface between the said end areas being capable of presenting or carrying indicia and the like.

These and other objects of the present invention will become more fully apparent with reference to the following specification and drawings which relate to a preferred embodiment of the present invention.

SUMMARY OF THE INVENTION

The elastic banding device of the present invention includes a continuous elongated web or ribbon of elastic material, such as, for example, polyethylene film or similar plastic materials which is sized such that when it is stretched it will slip over a group of containers such as six cans, twelve cans, or the like and when released, will exert an inward and uniform pressure around the group of containers or cans to provide a multi-container package thereof. Affixed to the outside surface of the endless loop of web or ribbon material is a strap-shaped handle of equal or lesser width having two ends adhesively affixed to the other surface of the endless loop or web such that when in an unstretched condition of the endless loop, the handle is bowed outwardly with respect to the endless loop surface, the two ends of the strap-shaped handle being closer together in the unstretched condition of the endless loop than the longitudinal extent of the strap shaped handle. Then, when the endless loop is stretched to a size sufficient to slip over a group of containers, the handle will have its ends moved farther apart to the extent that it will lie flat against the ultimate package and the outer surface of the endless loop. This way, the handle may be grasped and stretched from its relatively unstressed flush position against the stressed or stretched endless web to a stressed position caused by exerting a force against the handle sufficient to carry the group of containers held in the package configuration by the said endless web.

In an illustrated preferred embodiment of the present invention, the group of containers can be one or more six packs or cans or the like held together at their tops by stretch loops or matrices as shown in the prior art. Thus, a pair of six packs can be bound together in a twelve pack configuration by a single endless stretch band and integral handle assembly of the present invention or twelve cans or six cans or other groups of cans can be packaged solely by the use of the endless stretch band and handle without the additional top-engaging matrices.

In other preferred embodiments of the invention the handle means is illustrated as constructed from an underlying adhesive tape or strip having a longitudinally shorter preprinted paper overlay thereon of a width compatible with the tape. The width compatability is achieved either by nominal sizing or by folding. In the latter case, hidden premiums and the like may be included or sealed within the folds of the paper overlay for point-of-purchase promotions.

BRIEF DESCRIPTION OF THE DRAWINGS

FIG. 1 is a top-plan view of two six packs including top engaging stretch matrices with a single endless stretch band combining them into a twelve pack configuration with an integral handle;

FIG. 2 is a side elevation of the dual six pack configuration of FIG. 1;

DETAILED DESCRIPTION OF THE DRAWINGS

Figure 3:
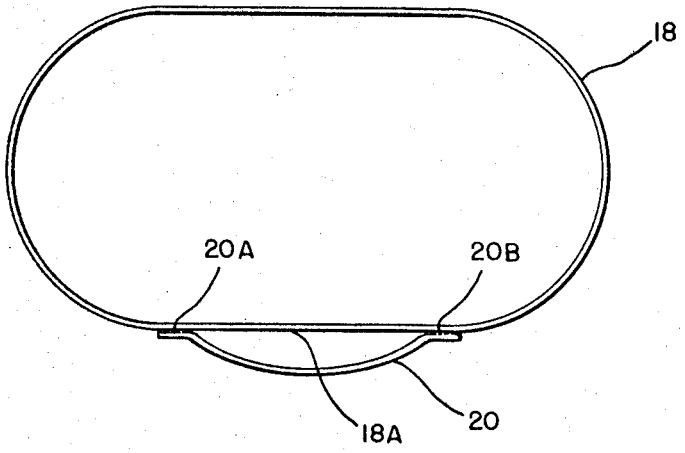
FIG. 3 is a top view of an unstretched endless band and handle prior to its application to a container package.

Referring in detail to the drawings and with particular reference to FIGS. 1 and 2, a multi-container package 10 consisting of two six-packs 12A and 12B of containers such as cans 14 are shown as being defined by first and second elastic loop matrices 16A and 16B, respectively.

The two six-packs 12A and 12B of containers 14 are joined together in a unitary multi-container package by means of a circumferential elastic band 18, which is formed in an endless configuration from a web or ribbon of elastic materials and envelops and grips the vertical sides of the cans or containers 14 to securely bind the two six-packs together in a single package unit.

An integral handle strap 20 extends along one side of the multi-container package 10 flush with the surface of the endless stretch band 18 and comprised of a similar material. The handle strap 20 includes bonded areas 20A and 20B at opposite ends thereof which maintain the handle strap bonded to the outer surface of the endless band 18.

As illustrated in FIG. 1, the handle strap 20 is moved from its solid line position, which is its quiescent position, to a dotted line position 20C when gripped to provide a handle for the multi-container package 10. The position 20C is assumed by the handle strap 20 due to the stretchability of the material from which the handle strap 20 is fabricated, this material being substantially identical to the material from which the endless band 18 is fabricated.

Figure 4:
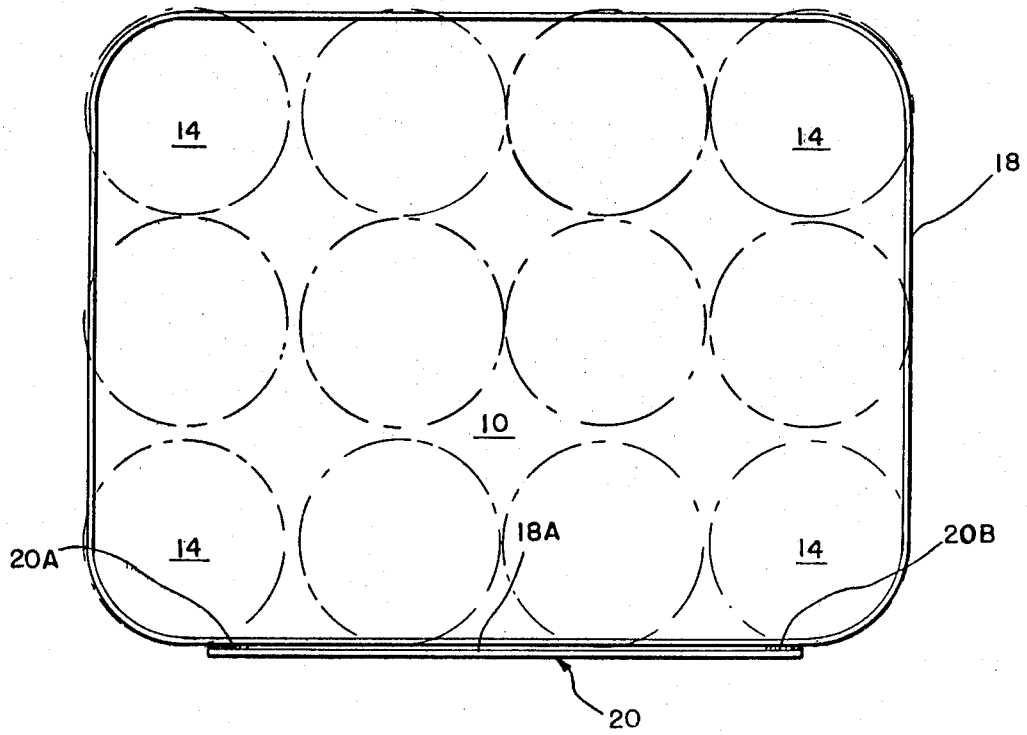
FIG. 4 illustrates the stretched band and handle schematically placed upon a multi-container package with the handle lying flush against the stretched band.

To further illustrate the structure and configuration of the endless band 18 and integral handle strap 20, reference is now made to FIGS. 3 and 4.

Referring first to FIG. 3, the endless band 18 is shown in a relatively unstretched or unstressed condition such that the side of the band 18 to which the handle strap 20 is attached at the points of bonding 20A and 20B is in a relaxed state, thereby causing the handle strap 20 to bow outwardly from the outermost surface 18A of the endless band 18 due to the fact that the bonded ends 20A and 20B of the handle strap 20 are closer together than would be the case when the band 18 has been stretched or stressed to fit over a plurality of containers or cans in a multi-container package configuration such as illustrated in FIG. 4, schematically.

In FIG. 4, in its stressed condition, the endless band 18 is shown as having been stretched to move the bonded ends 20A and 20B of the handle strap 20 sufficiently far apart such that the entire handle strap 20 lays substantially juxtaposed along the outer surface 18A of the endless web 18 between the bonded areas 20A and 20B. This is equivalent to the solid line position of the handle strap 20 initially referred to in FIG. 1 and illustrated in a side elevation in FIG. 2.

The number of containers in the can pack or a multi-container package 10 can be any suitable number such as six cans 14, twelve cans 14, etc., or more. Also, these container packages 10 can be provided with or without the top engaging elastic matrices such as 16A and 16B illustrated in FIGS. 1 and 2.

By forming the handle strap 20 and endless band 18 of similar material in the configuration of FIG. 3, the handle strap 20 is held in a straightened out and flush condition without being tensioned thereby permitting an easy stretching and extension of the handle strap for the purpose of carrying the multi-container package while at the same time maintaining the handle strap 20 out of the way during normal handling, stacking and the like.

The ends 20A and 20B of the handle strap 20 may be welded such as by ultrasonics or otherwise suitably bonded to the elastic band 18.

The tape, web or ribbon material of the endless belt 18 may be colored, printed, or otherwise decorated and the handle strap 20 can be made of a contrasting or different color to provide for easy customer identification of the handle. If desired, proof-of-purchase coupons of the like may comprise a portion of the handle strap 20.

The endless tape or band 18 may be initially fabricated by wrapping a tape around a suitable mandrel and causing the ends to be affixed one to the other in the formation of an endless band. Subsequently, similar tape of the same or contrasting color may be applied in a finite length with the ends thereof gapped as illustrated in FIG. 3 for the ends 20A and 20B to provide a relatively loose or looped handle strap 20 on the endless belt or tape 18. Subsequently, the belt or band 18 is placed upon a frame and stretched to the extent indicated in FIG. 4 or slightly greater to be fitted over a multi-container group such that when the frame releases the stretched band 18 it will grip the entire group of containers in a desired multi-container package configuration such as the package 10.

Figure 5:
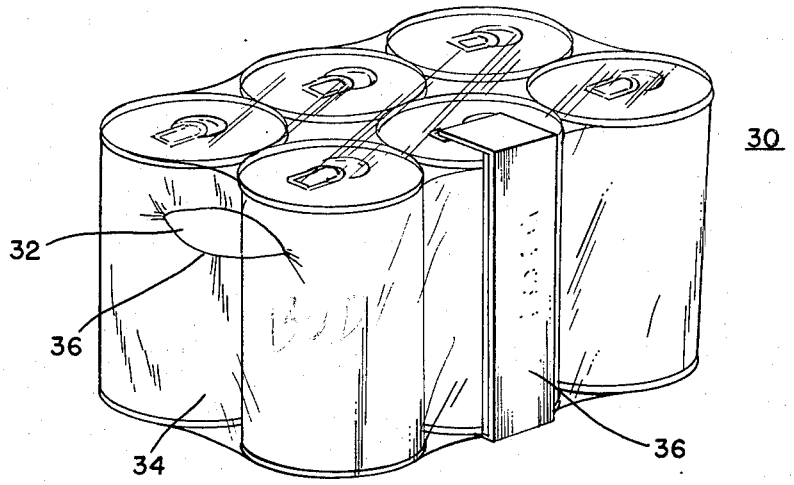
FIG. 5 is a perspective of a laminated handle structure of the present invention on a shrink film multi-container package.
Figure 6:
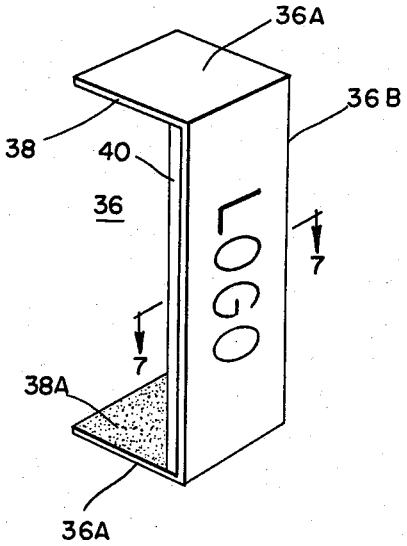
FIG. 6 is a perspective of a laminated handle of the present invention.

Referring in detail to FIGS. 5, 6 and 7 of the drawings, the laminated embodiment of the handle of the present invention will now be described.

A shrink film multiple container pack 30 is shown at FIG. 5 in which a plurality of containers 32 are held in place by a shrink film tube 34 which has been heat shrunk in place to partially close over the ends of the container and leave windows 36 therein through which the containers 32 are visible. The laminated handle is generally shown at 36 in position in FIG. 5 on the multi-container package 30 as well as in enlarged perspective prior to attachment to such a package 30 in FIG. 6.

Figure 7A:
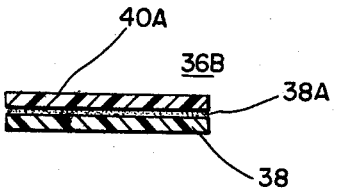
FIG. 7A is a detailed cross section of one embodiment of the handle of FIG. 6 taken along line 7—7.
Figure 7B:
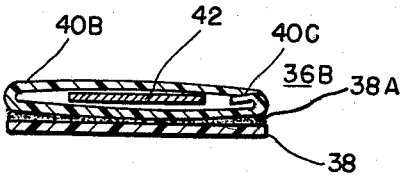
FIG. 7B is a detailed cross section of a folded laminate embodiment of the handle of FIG. 6 taken along line 7—7 thereof.

As generally illustrated in FIGS. 6, 7A and 7B, the laminated handle 36 has end portions 36A illustrated basically at right angles to the main body portion 36B thereof which are single layers of adhesive tape 38 having layers of adhesive 38A thereon. The adhesive layers 38A are positioned to engage the outer surfaces of the shrink film 34 of the multiple container package 30 for the purpose of mounting the handle structure 36 on the package 30. In this regard, the adhesive layers 38A can be pressure sensitive adhesive, contact adhesive or hot melt type adhesive, depending upon the nature of the multi-container package 30. For example, the multi-container package 30 while illustrated as including a shrink film or tube 34 could be made from a stretch film or from a paperboard tube and the adhesive layer 38A would be selected so as to be compatible with the underlying material.

As illustrated in FIGS. 7A and 7B the tape 38 and adhesive layer 38A extend coterminately with the entire handle structure 36 such that the central portion 36B, by means of the adhesive layer 38A, can be provided with an interior laminate 40 which is coextensive with the central portion 36B of the handle 36 and which is held in place by the adhesive layer 38A.

As illustrated in FIG. 7A, the central portion 36B is comprised of a single layer interior laminate 40A, the adhesive layer 38A and the tape or carrier 38 for the adhesive layer 38A. Needless to say, the combination of the tape 38 and adhesive layer 38A can be provided by a common adhesive tape configuration upon which the laminates 40 and 40A are secured.

In FIG. 7B, there is provided an interior laminate 40B which is a folded envelope type structure having a sealed seam 40C therein which contains a removable premium 42. This entire structure 40B is adhesively held on the adhesive layer 38A and the tape 38 to complete the central structure 36B of this particular embodiment.

Further, as illustrated in FIG. 6, the tape 38 and the adhesive layer 38A may be basically transparent such that a logo indicated by the word "Logo" in FIG. 6 or other advertising material and information may be printed on the adhesive adjacent side of the interior laminate 40 to be viewed through the tape 38 on the gripping portion or central portion 36B of the handle 36.

It can readily be seen by reference to FIGS. 5 and 6 that the interior laminate 40, in any of the embodiments such as those designated by 40A and 40B, by virtue of the construction of the handle 36 are held in closely adjacent position with respect to the side surface of the multiple container package 30. This positioning of the interior laminate 40 closely adjacent the side surface of the multi-container package 30 discourages pilferage of premiums and coupons and other materials which are embodied in the interior laminate 40.

It should be understood that the ELASTIC BAND AND HANDLE STRUCTURE FOR FORMING PACKAGES OF GROUPS OF CONTAINERS may be modified as would occur to one of ordinary skill in the art without departing from the spirit and scope of the present invention.

It is claimed:

1. In combination with a wrapper of material defining a package configuration:

an elongated handle strap of finite length extending over substantially a like finite adjacent surface length of a said wrapper;

said handle strap having first and second ends secured to said wrapper and having the surface area intermediate its ends substantially juxtaposed with the adjacent said surface of said wrapper;

said wrapper comprising an endless band of elastic material for surrounding a said package configuration in a stretched and tensioned condition;

said handle strap being in substantially unstretched condition when said endless band is in said stretched and tensioned condition;

said handle strap being in a relatively loose and non-juxtaposed condition with respect to said adjacent surface of said endless band when the latter is in an unstretched condition; and said handle strap comprising:

an elongated strip of material having a coextensive layer of adhesive thereon;

a central gripping portion defined by a centrally disposed laminate adhered to said adhesive layer while leaving an exposed area of said layer of adhesive at each end thereof;

said exposed areas of said layer of adhesive providing securing means for holding said handle strap on said wrapper.

2. The invention of claim 1, wherein said centrally disposed laminate comprises a preprinted sheet of material bearing indicia visible through said strip of material.

3. The invention of claim 1 or 2, wherein said centrally disposed laminate comprises an envelope.

4. Elastic banding means for maintaining at least one group of containers in a multi-container package configuration comprising:

an endless band of elastic material for surrounding and gripping the sides of a multiplicity of containers prearranged in a desired multi-container package configuration of at least one group of containers while said endless band means is in a stretched and tensioned condition;

an elongated handle strap of finite length extending over substantially a like finite adjacent surface length of said stretched endless band;

said handle strap further having first and second ends secured to said endless band and having the surface area intermediate its ends substantially juxtaposed with the adjacent said surface of said endless band;

said handle strap being in substantially unstretched condition when said endless band is in said stretched and tensioned condition; and said handle strap being in a relatively loose and non-juxtaposed condition with respect to said adjacent surface of said endless band when the latter is in an unstretched condition;

said handle strap comprising:

an elongated strip of material having a coextensive layer of adhesive thereon; and a central gripping portion defined by a centrally disposed laminate adhered to said adhesive layer while leaving an exposed area of said layer of adhesive at each end thereof;

said exposed areas of said layer of adhesive providing securing means for holding said handle strap on said wrapper.

5. The invention of claim 4, wherein said centrally disposed laminate comprises a preprinted sheet of material bearing indicia visible through said strip of material.

6. The invention of claim 4 or 5 wherein said centrally disposed laminate comprises an envelope.

7. The invention defined in claim 4 or 5, in combination with a said multiplicity of containers including at least two preformed groups of containers;

said endless band encompassing both said groups to define said desired multi-container package configuration.

* * * * *